United States Patent [19]

King

[11] 4,416,401

[45] Nov. 22, 1983

[54] CLOTHES HANGER

[76] Inventor: Richard J. King, c/o Reel King, Inc., 149 Hamilton St., Leominster, Mass. 01453

[21] Appl. No.: 360,399

[22] Filed: Mar. 22, 1982

[51] Int. Cl.[3] ..... A47J 51/082; A47J 51/097

[52] U.S. Cl. ..... 223/88; 223/92; 211/113; D6/256

[58] Field of Search ..... 223/85, 88, 92, 97, 223/87, 91; D6/257, 251, 249, 256; 211/113, 211/119, 118; 248/339, 340; 206/290, 291, 300

[56] References Cited

U.S. PATENT DOCUMENTS

| | | | |
|---|---|---|---|
| 1,492,574 | 5/1924 | Montgomery | 223/92 |
| 1,820,419 | 8/1931 | Webbe | 223/91 |
| 2,498,400 | 2/1950 | DuLude | 223/88 |
| 2,753,143 | 7/1956 | Berlt | 223/88 X |
| 2,891,706 | 6/1959 | O'Riley | 223/91 |
| 3,123,331 | 3/1964 | Field et al. | 211/113 X |
| 3,710,996 | 1/1973 | Smilow et al. | 223/87 |
| 4,007,861 | 2/1977 | Duester et al. | 223/85 |
| 4,063,669 | 12/1977 | Smilow et al. | 223/87 |
| 4,335,838 | 6/1982 | Bisk et al. | 223/91 |

FOREIGN PATENT DOCUMENTS

| | | | |
|---|---|---|---|
| 739180 | 10/1932 | France | 223/87 |
| 1454403 | 8/1966 | France | 223/85 |
| 2436276 | 5/1980 | France | 211/113 |

*Primary Examiner*—Robert Mackey
*Attorney, Agent, or Firm*—Charles R. Fay

[57] ABSTRACT

A one piece semi-flexible garment hanger having a flexible strap adjacent the hook of the hanger. The strap may be doubled and fastened in a loop to hold the bottom bar of the hanger to the top bar and hook in tensed, stiffened condition, or further hangers can have the hooks thereof engage the loops of prior hangers to make a multiple hanger construction.

2 Claims, 4 Drawing Figures

CLOTHES HANGER

BACKGROUND OF THE INVENTION

There are many plastic clothes hangers in use, but most of them are apt to droop under heavy loads, overcoats and topcoats. Also, if strung together to make a multiple hanger construction, they are not stable and are farther apart than is necessary.

SUMMARY OF THE INVENTION

A one-shot plastic clothes hanger in generally conventional shape is formed of semi-flexible resilient plastic material. This hanger has a hook fixed in position and a flexible strap depending into the area of the bars forming the hanger. Spaced fasteners provide that this strap is capable of selective formation into a loop, and the loop may be used to hold the bottom bar of the hanger in flexed condition under tension to considerably stiffen and thereby strengthen the hanger to satisfactorily hold heavy coats, etc. without drooping.

PREFERRED EMBODIMENT OF THE INVENTION

The garment or clothes hanger of the present invention may be of generally conventional triangle shape with a straight bottom bar 10, end connected sloping bars 12, 14, and a hook 16 at the apex 18. The material is plastic of a semi-flexible resilient nature, so that the straight bar 10 can be manually flexed into the position of FIG. 3 wherein the bars 12, 14 are generally parallel to the now two parts of the flexed bottom bar, no longer straight.

Figure 1:
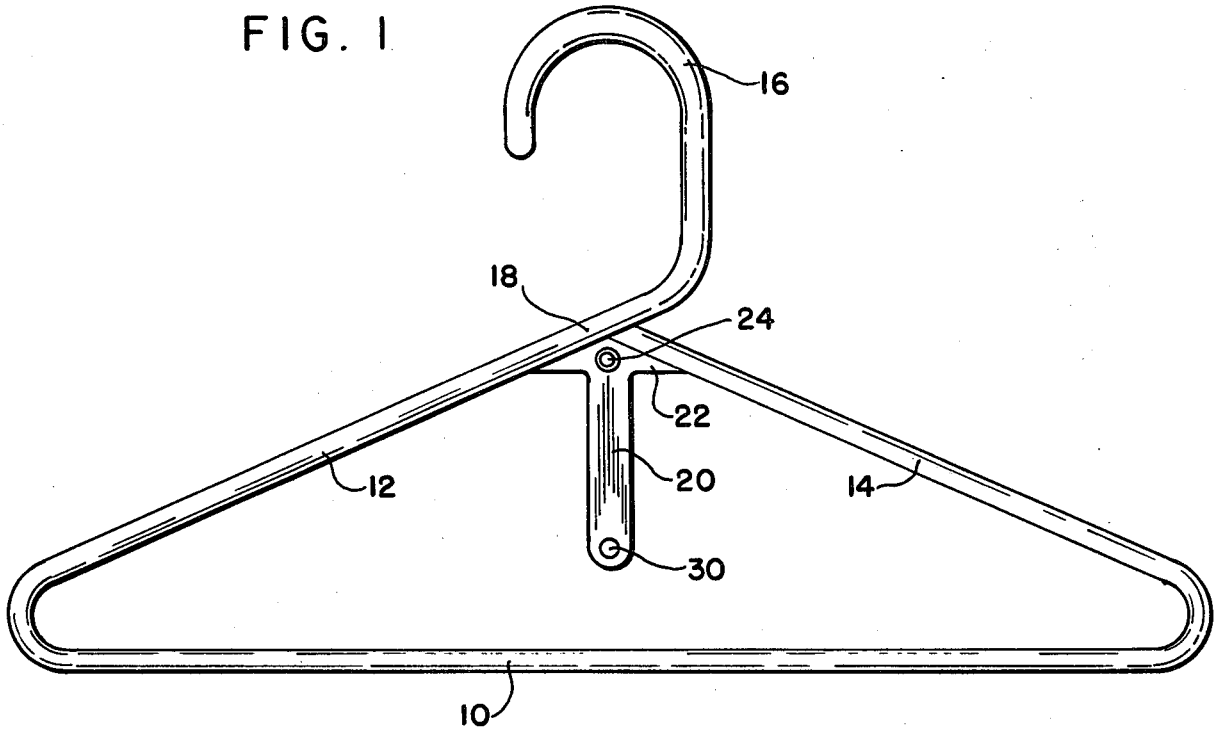
FIG. 1 is an elevational view of the hanger.
Figure 2:
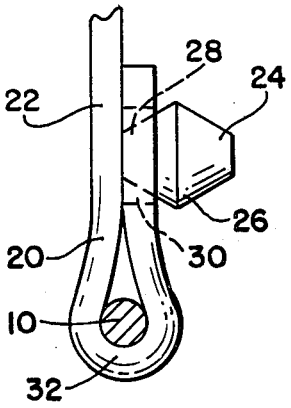
FIG. 2 is an enlarged section showing the strap in its looped form.

A flexible flat strap 20 depends from a triangular gusset or strengthening fin 22 and at 24 there is a stud, FIG. 2, having an enlarged head 26 making a reduced neck 28. Adjacent the other end of the strap, there is a hole 30. The strap is free ended and more flexible than the rest of the hanger and is easily bent up to snap the hole over the head of the stud forming the loop 32 of FIG. 2. The inside diameter of the hole is less than the diameter of the head 26. All of the parts of the hanger, including the stud, are integral and molded in one operation.

Figure 3:
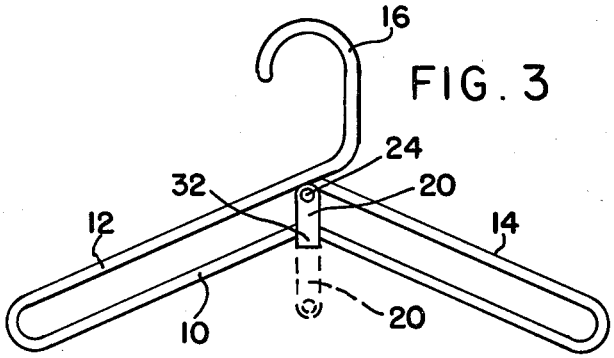
FIG. 3 shows the hanger in stiffened form.

When a stiffer hanger is desired, the user flexes the bar 10 up to the FIG. 3 position and snaps the strap over it, holding the parts as in FIG. 3. This places the bar under tension and stiffens the hanger to a degree so that the hanger easily accommodates heavy loads, overcoats, etc. The strap may be unsnapped, and the hanger used as usual.

Figure 4:
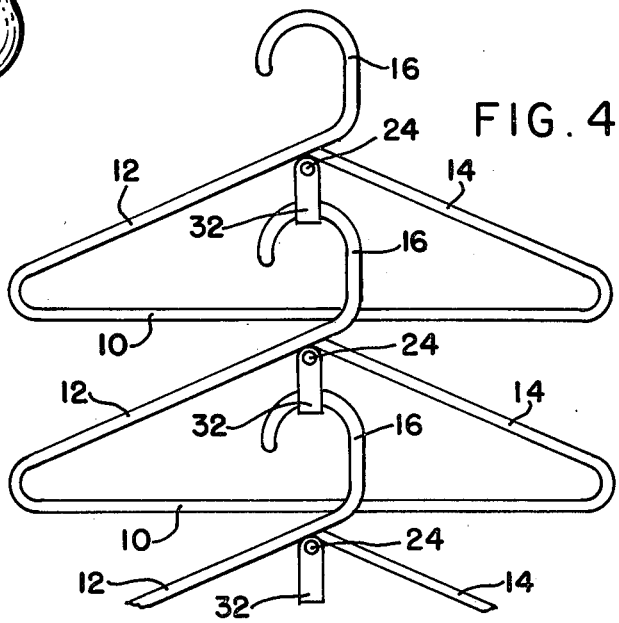
FIG. 4 is a diagram showing multiple hangers.

The hooks 16 are fixed in relation to the top bars and in the plane of the bars. With the loop formed, it is very easy to slip the hook of a second hanger into it, and this can be continued with more like hangers, see FIG. 4. The result is a stable multiple hanger with more hangers and more stable hangers per unit of vertical distance than in cases where the hooks are detachably strung on the bottom bars.

I claim:

1. A one-piece molded clothes hanger of plastic material comprising a hook, a closed loop including a bottom generally straight bar and connected bars sloping upwardly from the ends of the straight bar to the hook, said bars having a degree of resilient flexibility so that the bottom straight bar may be flexed so that its center portion approaches the junction of the sloping bars and returns to original shape upon release of the force flexing the straight bar, a thin flexible strap molded integral with the hanger and having an end at the junction of the sloping bars and depending therefrom, a hole at one end of the strap, a stud at the other end thereof, the stud having an enlarged head with a diameter greater than that of the hole so that the hole end of the strap is detachably connectible to the stud end making a loop, whereby said loop formed from said flexible strap is capable of receiving said straight bottom bar in flexed condition and holding said bottom bar flexed, or is capable of receiving the hook of another hanger.

2. The clothes hanger of claim 1 wherein the sloping bars are generally parallel to parts of the flexed bottom bar.

* * * * *